US008955343B2

(12) United States Patent
Verma et al.

(10) Patent No.: US 8,955,343 B2
(45) Date of Patent: Feb. 17, 2015

(54) EJECTOR CYCLE REFRIGERANT SEPARATOR

(75) Inventors: Parmesh Verma, Manchester, CT (US); Jinliang Wang, Ellington, CT (US); Frederick J. Cogswell, Glastonbury, CT (US); Hans-Joachim Huff, Manlius, NY (US); Alexander Lifson, Manlius, CT (US); Richard G. Lord, Murfreesboro, TN (US)

(73) Assignee: Carrier Corporation, Farmington, CT (US)

( * ) Notice: Subject to any disclaimer, the term of this patent is extended or adjusted under 35 U.S.C. 154(b) by 91 days.

(21) Appl. No.: 13/522,121

(22) PCT Filed: Jul. 20, 2011

(86) PCT No.: PCT/US2011/044626

§ 371 (c)(1),
(2), (4) Date: Jul. 13, 2012

(87) PCT Pub. No.: WO2012/012496

PCT Pub. Date: Jan. 26, 2012

(65) Prior Publication Data

US 2012/0291462 A1 Nov. 22, 2012

Related U.S. Application Data

(60) Provisional application No. 61/367,097, filed on Jul. 23, 2010.

(51) Int. Cl.
*F25B 1/00* (2006.01)
*F25B 41/00* (2006.01)
(Continued)

(52) U.S. Cl.
CPC ..... *F25B 41/00* (2013.01); *F25B 40/00* (2013.01); *F25B 43/006* (2013.01); *F25B 1/10* (2013.01);
(Continued)

(58) Field of Classification Search
CPC ..... F25B 40/00; F25B 43/006; F25B 1/10; F25B 2341/0011; F25B 2400/23; F25B 41/00; F25B 2341/0012; F25B 2309/061
USPC ..... 62/115, 500, 498, 512
See application file for complete search history.

(56) References Cited

U.S. PATENT DOCUMENTS 1,836,318 A 12/1931 Gay
3,277,660 A 10/1966 Kemper et al.
(Continued)

FOREIGN PATENT DOCUMENTS

CN 1316636 A 10/2001
DE 10200811255 A1 9/2009
(Continued)

OTHER PUBLICATIONS

International Search Report and Written Opinion for PCT/US2011/044626, dated Jan. 13, 2012.
(Continued)

*Primary Examiner* — Mohammad M Ali
(74) *Attorney, Agent, or Firm* — Bachman & LaPointe, P.C.

(57) ABSTRACT

A system has a compressor. A heat rejection heat exchanger is coupled to the compressor to receive refrigerant compressed by the compressor. An ejector has a primary inlet coupled with heat rejection heat exchanger to receive refrigerant, a secondary inlet, and an outlet. The system has a heat absorption heat exchanger. The system includes means for providing at least of a 1-10% quality refrigerant to the heat absorption heat exchanger and an 85-99% quality refrigerant to at least one of the compressor and, if present, a suction line heat exchanger.

20 Claims, 6 Drawing Sheets

(51) Int. Cl.
*F25B 40/00* (2006.01)
*F25B 43/00* (2006.01)
*F25B 1/10* (2006.01)

(52) U.S. Cl.
CPC ... *F25B 2309/061* (2013.01); *F25B 2341/0011* (2013.01); *F25B 2341/0012* (2013.01); *F25B 2400/23* (2013.01); *F25B 2600/21* (2013.01)
USPC ..... 62/115; 62/500; 62/512

(56) References Cited

U.S. PATENT DOCUMENTS

| | | | | |
|---|---|---|---|---|
| 5,531,080 | A * | 7/1996 | Hirahara et al. | 62/470 |
| 5,996,360 | A * | 12/1999 | Tanaka et al. | 62/160 |
| 6,574,987 | B2 * | 6/2003 | Takeuchi et al. | 62/500 |
| 6,901,763 | B2 * | 6/2005 | Memory et al. | 62/113 |
| 7,086,248 | B2 * | 8/2006 | Sakai et al. | 62/500 |
| 7,367,202 | B2 * | 5/2008 | Yamada et al. | 62/500 |
| 7,690,219 | B2 * | 4/2010 | Suzuki et al. | 62/512 |
| 2004/0065112 | A1 | 4/2004 | Sakai et al. | |
| 2004/0123624 | A1 | 7/2004 | Ohta et al. | |
| 2004/0261449 | A1 * | 12/2004 | Memory et al. | 62/513 |
| 2007/0028630 | A1 | 2/2007 | Yamada et al. | |
| 2008/0196446 | A1 | 8/2008 | Nakamura et al. | |

FOREIGN PATENT DOCUMENTS

| | | | |
|---|---|---|---|
| EP | 1134517 | A2 | 9/2001 |
| JP | 2002349978 | A | 12/2002 |
| JP | 2007147198 | A | 6/2007 |
| WO | 2010036480 | A2 | 4/2010 |

OTHER PUBLICATIONS

Chinese Office Action for Chinese Patent Application No. 201180036106.1, dated Sep. 2, 2014.

* cited by examiner

EJECTOR CYCLE REFRIGERANT SEPARATOR

CROSS-REFERENCE TO RELATED APPLICATION

Benefit is claimed of U.S. Patent Application Ser. No. 61/367,097, filed Jul. 23, 2010, and entitled "Ejector Cycle Refrigerant Separator", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. Nos. 1,836,318 and 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other liquid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the secondary nozzle convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Various modifications of such ejector systems have been proposed. One example in US20070028630 involves placing a second evaporator along the line 46. US20040123624 discloses a system having two ejector/evaporator pairs. Another two-evaporator, single-ejector system is shown in US20080196446.

SUMMARY

One aspect of the disclosure involves a system having a compressor. A heat rejection heat exchanger is coupled to the compressor to receive refrigerant compressed by the compressor. An ejector has a primary inlet coupled with heat rejection heat exchanger to receive refrigerant, a secondary inlet, and an outlet. The system has a heat absorption heat exchanger. The system includes means for providing at least of a 1-10% quality refrigerant to the heat absorption heat exchanger and an 85-99% quality refrigerant to at least one of the compressor and, if present, a suction line heat exchanger.

In various implementations, an expansion device may be immediately upstream of the heat absorption heat exchanger. The refrigerant may comprise at least 50% carbon dioxide, by weight.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 3:
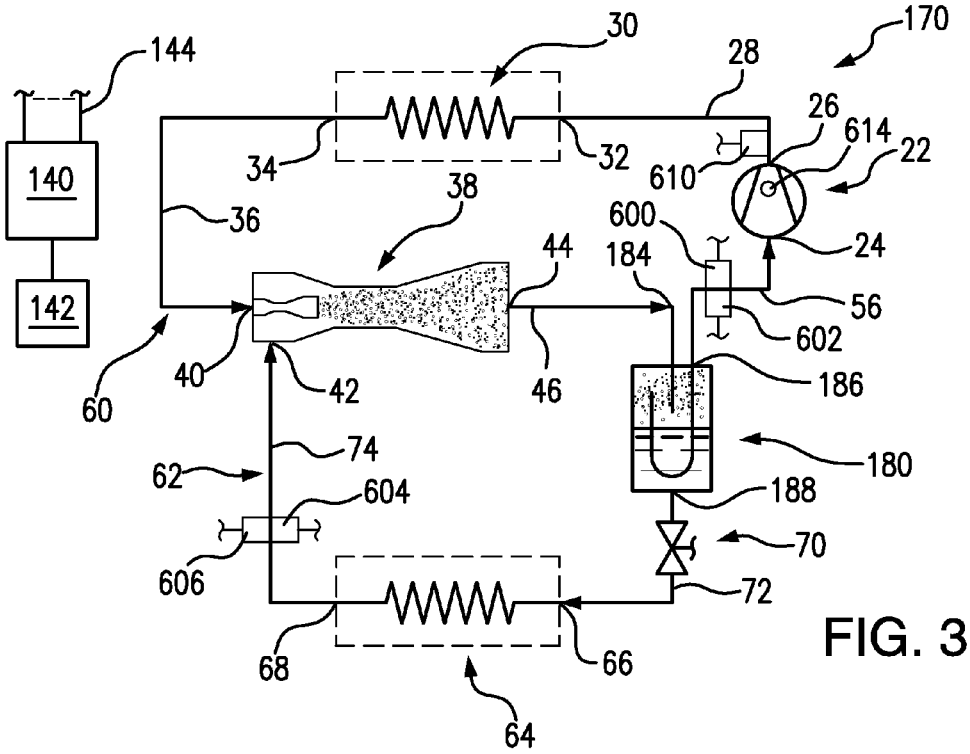
FIG. 3 is a schematic view of a first refrigeration system.

FIG. 3 shows an ejector cycle vapor compression (refrigeration) system 170. The system 170 may be made as a modification of the system 20 or of another system or as an original manufacture/configuration. In the exemplary embodiment, like components which may be preserved from the system 20 are shown with like reference numerals. Operation may be similar to that of the system 20 except as discussed below with the controller controlling operation responsive to inputs from various temperature sensors and pressure sensors.

Figure 1:
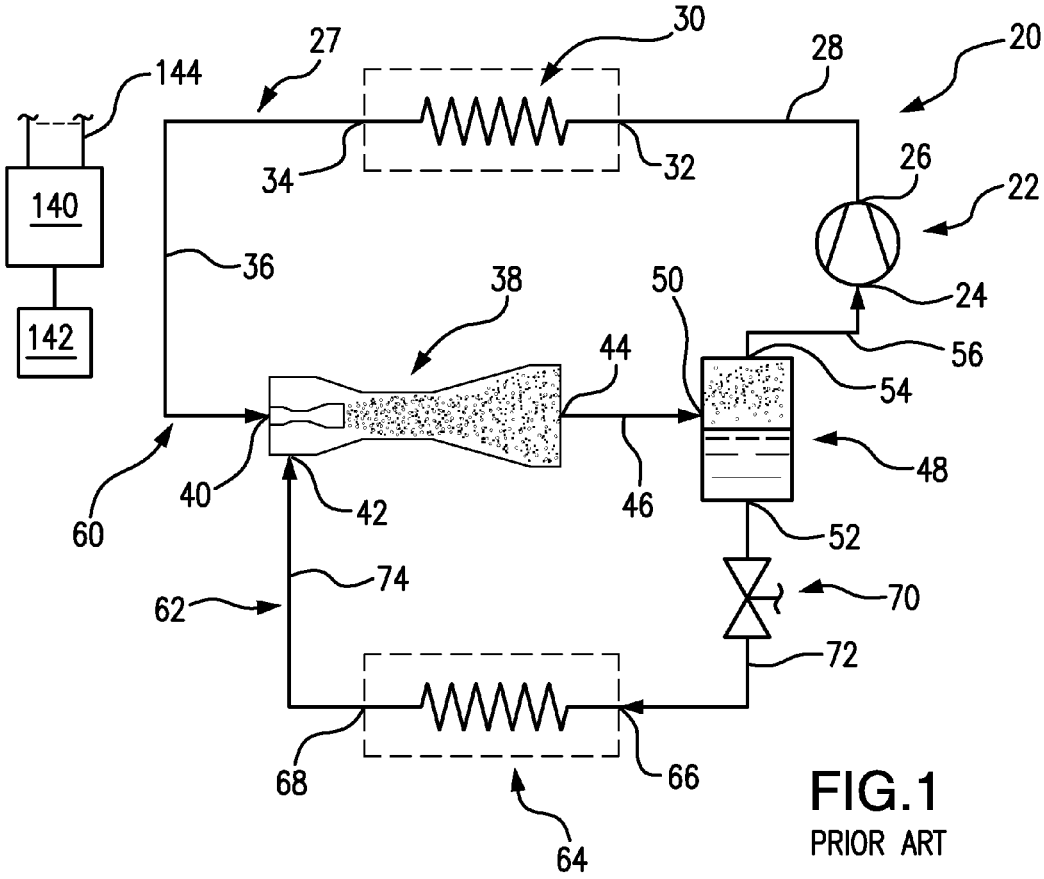
FIG.1 PRIOR ART
FIG. 1 is a schematic view of a prior art ejector refrigeration system.
Figure 2:
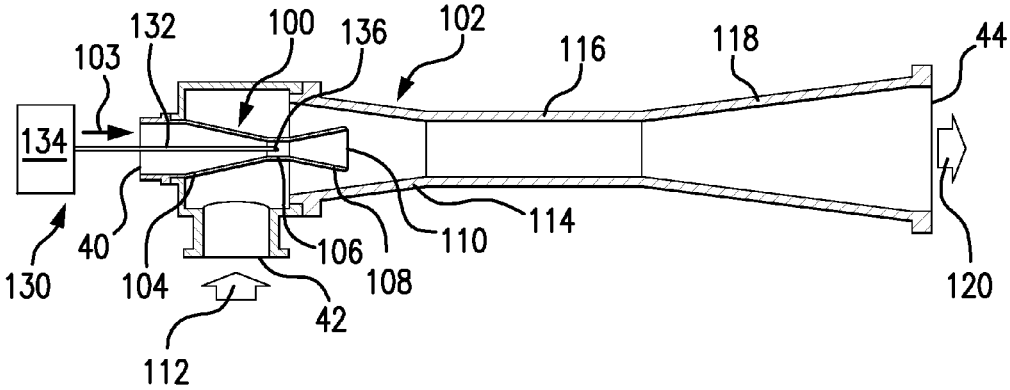
FIG. 2 PRIOR ART
FIG. 2 is an axial sectional view of an ejector.

Whereas the separator 48 of FIG. 1 delivers essentially pure gas from its gas outlet, and essentially pure liquid from its liquid outlet, it may be desirable to replace one or both of these flows with a slightly mixed state flow.

For example, by feeding a two-phase mixture into the compressor, the discharge temperature of the compressor can be reduced if desired (thus extending the compressor system operating range). Feeding a suction line heat exchanger (SLHX—discussed below) and/or compressor with small amount liquid are also expected to improve both SLHX and compressor efficiency. Exemplary refrigerant is delivered as 85-99% quality (vapor mass flow percentage), more narrowly, 90-98% or 94-98%. The power required for compression of a vapor increases which increased suction enthalpy. For hermetic compressors the refrigerant vapor is used to cool the motor. For example, in many compressors, the suction flow is first passed over the motor before entering the compression chamber (raising the temperature of refrigerant reaching the compression chamber). By supplying a small amount of liquid in the vapor of the suction flow, the motor can be cooled while reducing the temperature increase of the refrigerant as it passes over the motor. Furthermore, some compressors are tolerant of small amounts of liquid entering the suction chamber. If the compression process is begun with some liquid, the refrigerant will remain cooler than it otherwise would, and less power is required for the compression process. This is especially beneficial with refrigerants that exhibit a large degree of heating during compression, such as $CO_2$. The negative side of providing liquid refrigerant to the compressor is that the liquid is no longer available for producing cooling in the evaporator 64. The optimum choice of quality provided to line 56 is determined by the specific characteristics of the system to balance these considerations.

A small amount of liquid refrigerant can also be used to improve the performance of a SLHX. SLHXs are typically of counter-flow design. The total heat transfer is limited by the fluid side that has the minimum product of flow rate and specific heat. For a refrigeration system SLHX with pure vapor on the cold side and pure liquid on the hot side, the cold-side vapor is limiting. However, a small amount of liquid provided to the cold-side effectively increases its specific heat. Thus more heat may be transferred from the same SLHX, or conversely, for the same heat transfer a smaller heat exchanger may be used if a small amount of liquid is added to the vapor.

Also by feeding a two-phase mixture to the expansion valve upstream of the evaporator one can precisely control the system capacity, which can prevent unnecessary system shutdowns (comfort and improved reliability) and improve temperature control. This may help improve refrigerant distribution in the evaporator manifold and further improve evaporator performance Exemplary refrigerant is delivered as 1-10% quality (vapor mass flow percentage), more narrowly 2-6%. Direct expansion evaporators typically have poor heat transfer in the very low and very high quality ranges. For these evaporator designs providing higher quality may improve the heat transfer coefficient at the entrance region of the evaporator (where quality is the lowest).

The system 170 replaces the separator with means for providing at least one of the 1-10% quality refrigerant to the heat absorption heat exchanger and the 90-99% quality refrigerant to at least one of the compressor and, at present, a suction line heat exchanger.

Figure 4:
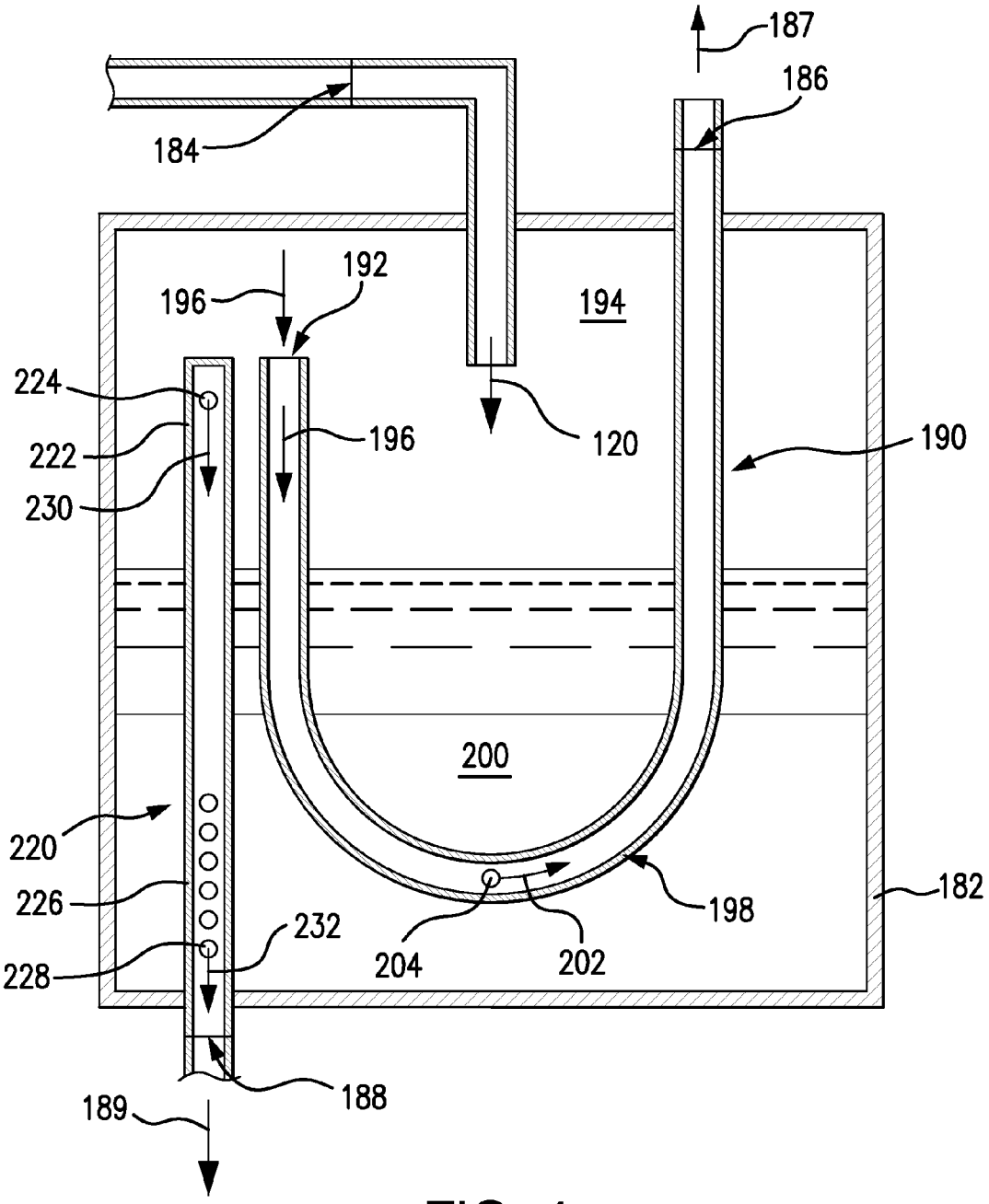
FIG. 4 is an enlarged view of a separator of the system of FIG. 3.

Exemplary means 180 (FIG. 4) may be based upon a conventional accumulator and may serve as means providing both said 1-10% quality refrigerant and said 90-99% quality refrigerant. The modified accumulator has a tank or vessel 182, an inlet 184, a first outlet 186 for discharging the high quality refrigerant 187, and a second outlet 188 for discharging the low quality refrigerant 189.

The exemplary first outlet 186 is at the downstream end of a U-tube (or J-tube) 190. The U-tube extends to a second end (gas inlet end) 192 open to the headspace 194 of the tank for drawing a flow 196 of gas from the headspace. A lower portion (trough or base) 198 of the U-tube is immersed in the liquid refrigerant accumulation 200 in a lower portion of the tank, below the headspace. To entrain the desired amount of liquid 202 into the gas flow to form the high quality flow 187, or more holes 204 may be formed along the U-tube, including in the lower portion 198. The hole sizing and locations are configured to provide the desired quality of two phase mixture entering the SLHX and/or compressor. An exemplary hole size for a drilled hole 204 is 0.01 inch-0.5 inch (0.25 mm-12.7 mm), more narrowly 0.2-0.3 inch (5.1-7.6 mm). Multiple holes may be used and may be placed to achieve desired results.

To provide the small amount of gas in the low quality flow 189, one or more vapor line tubes 220 may extend from a portion 222 having one or more gas inlets (holes) 224 in the headspace. An exemplary portion 222 is a closed and an upper portion. A second portion 226 (a lower portion) has one or more holes 228 within the liquid accumulation 200. The sizes of the holes 228 and 224 are selected so that a flow 230 of gaseous refrigerant is drawn through the holes 224 and becomes entrained in a flow of liquid refrigerant 232 drawn through the holes 228 to provide the desired composition of the low quality flow 189. Exemplary size for the holes 224 is up to two inches (50 mm) in diameter for drilled holes or equivalent area for others, more narrowly, 0.1-0.5 inches (2.5-13 mm) or 0.1-0.3 inches (2.5-7.6 mm). Exemplary size for the holes 228 is 0.1-2 inches in diameter for drilled holes or equivalent area for others, more narrowly f 0.2-1.0 inches (5-25 mm) or 0.25-0.75 inches (6.35-19.1 mm). The ratio of hole sizes (#224 vapor to 228 liquid) is 0 to 0.9; more narrowly 0.1 to 0.5; more narrowly 0.1 to 0.3.

Figure 5:
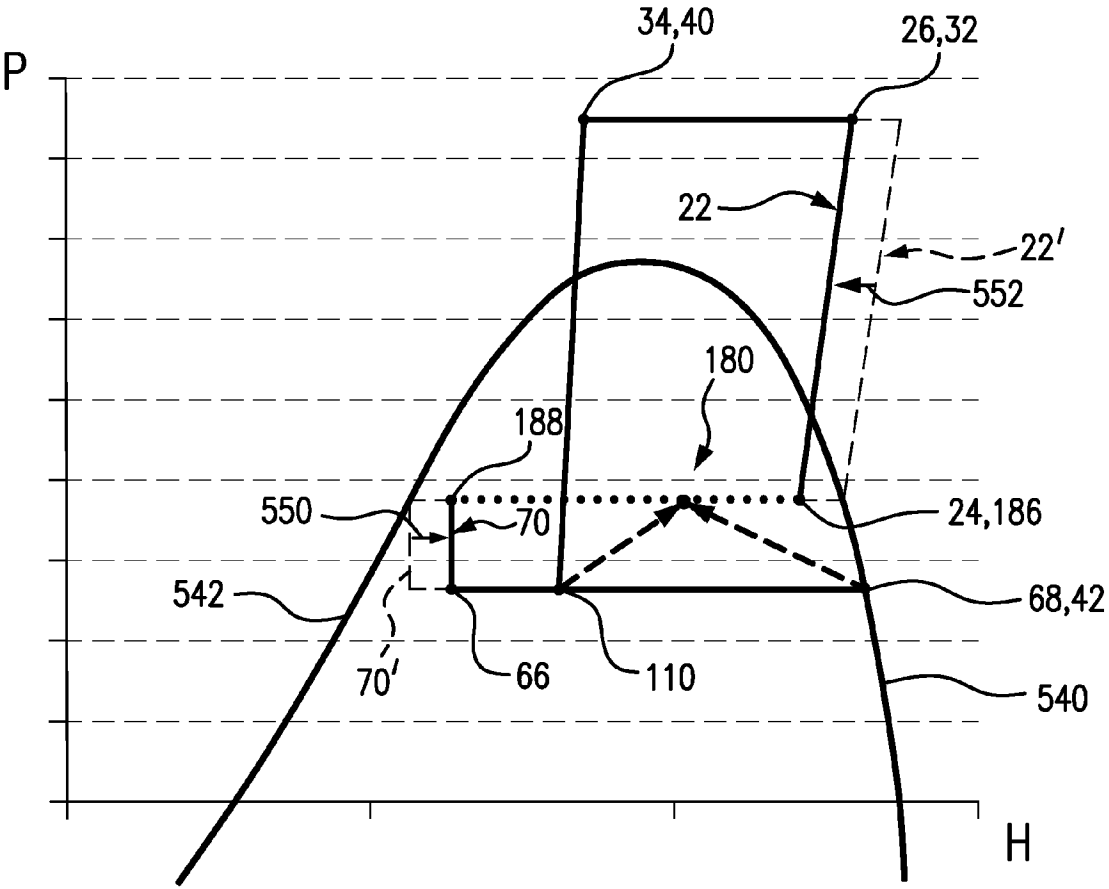
FIG. 5 is a pressure-enthalpy diagram of the system of FIG. 3.

FIG. 5 shows a pressure-enthalpy (P-H) diagram of the system with an approximate refrigerant quality of 0.1 being delivered to the expansion valve (70) and an approximate refrigerant quality of 0.9 delivered to the compressor suction port (24). The change in refrigerant quality provided to the expansion device causes a shift 550 in the enthalpy of the expansion process from a baseline shown as 70' to the higher enthalpy shown for the evaporator 70. Similarly, there is a shift 552 reducing the enthalpy of the compression process from a baseline shown as 22' to the modified value shown for the compressor 22 in the modified system. The shift 550 moves the outlet 52 (which forms the inlet condition of the expansion device 70) further to the high enthalpy side of the saturated liquid line 542 (e.g., from a baseline closer to, along, or to the low enthalpy side of that line). Similarly, the shift 552 brings further to the outlet 54 and compressor suction condition 24 to the low enthalpy side of the saturated vapor line 540 (e.g., from a baseline closer to, along, or to the high enthalpy side thereof).

Figure 6:
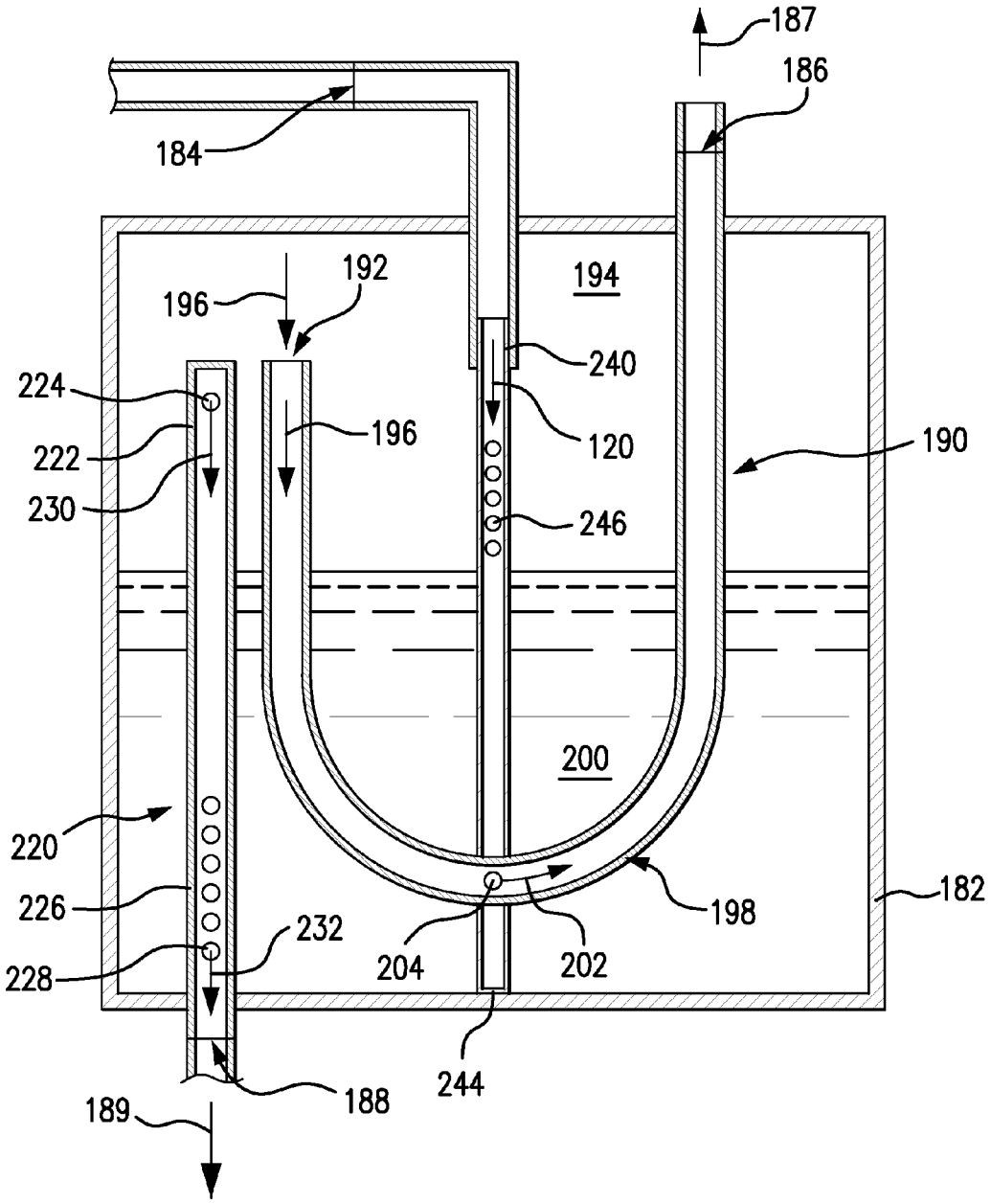
FIG. 6 is an enlarged view of an alternate separator.

FIG. 6 modifies the means 180 by inserting an upper end 240 of a tube insert 242 into the inlet conduit (and securing via welding, clamping, or the like). A lower end 244 of the tube 242 is closed and sits on the bottom of the vessel (e.g., for support so as to minimize stress on the joint with the inlet conduit). Along an intermediate portion (still above a surface of the accumulation 200) the tube 242 bears apertures 246. The apertures 246 deflect the inlet flow 120 to reduce the velocity with which the inlet flow encounters the accumulation. For example, the apertures 246 may cause the inlet flow to deflect off the sidewall of the vessel (e.g., flow down the sidewall to the accumulation). This deflection reduces foaming in the accumulation 200 and helps provide controlled balances of vapor and liquid in the flows 187 and 189.

In one exemplary implementation, the inlet tube has an inner diameter (ID) of 15.9 mm which corresponds to a particular standard tube size. Other sizes may be used depending upon system requirements. In the example, the holes 246 are grouped in two rows of five holes with each hole of one group diametrically opposite an associated hole of the other group. The exemplary holes are 0.25 inch (6.35 mm) in diameter. Other patterns of holes may be provided. For example, the patterns may be provided to create specific flow patterns, to accommodate other internal components, or the like. Similarly, hole orientation may be varied off radial or off horizontal. For example, angling of the holes upward at angles of up to 45° off horizontal/radial may allow the flows along the sidewall to use more of the sidewall. More broadly, an exemplary tube size for the inlet conduit or an insert therein is one eighth of an inch to two inches (3.2 mm-50.8 mm). Similarly, an exemplary range of hole sizes (especially for drilled holes) is 0.8 mm-20 mm in diameter depending upon the desired flow rate, conduit size, etc. Non-circular holes may have similar exemplary cross-sectional areas. An exemplary ratio of total hole area to local tube internal cross-sectional area is 0.5-20, more narrowly 1-5 or 1-2.

Figure 7:
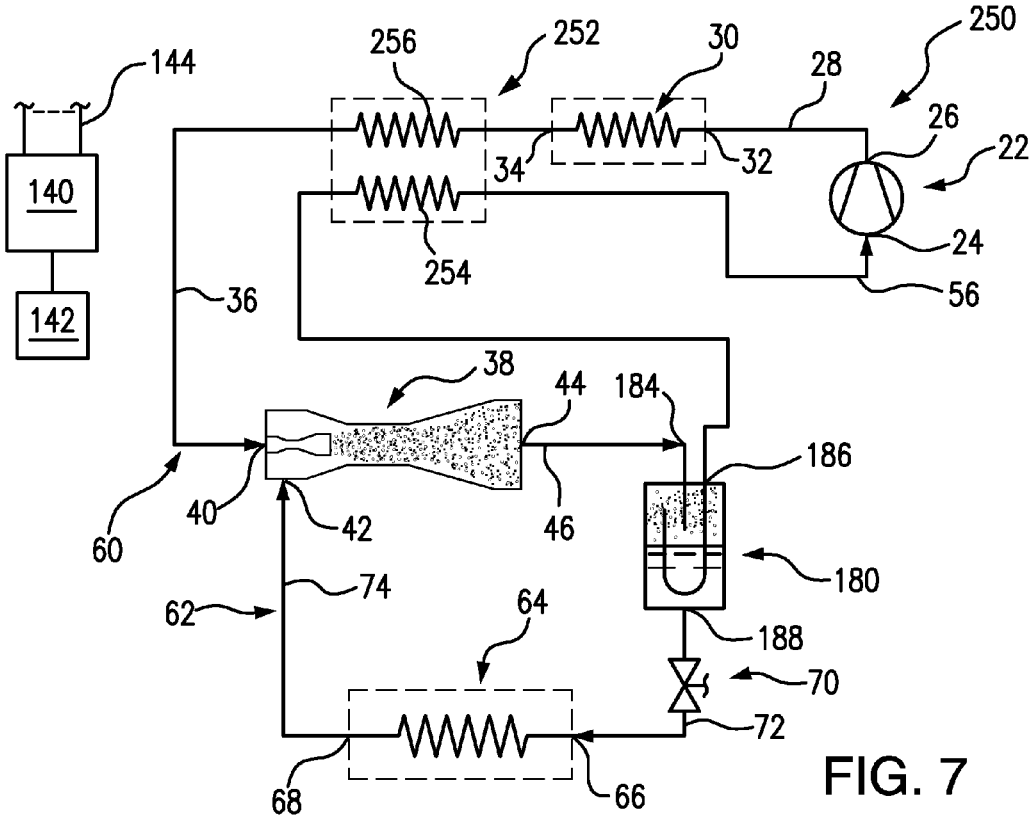
FIG. 7 is a schematic view of a second refrigeration system.

FIG. 7 shows a system 250 which may be made as a further modification of the systems of FIG. 1 or 3 or of another system or as an original manufacture/configuration. In the exemplary embodiments, like components which may be preserved from the system 170 are shown with like reference numerals. Operation may be similar to that of the system 170 except as discussed below. The system 250 is otherwise similar to the system 170 but features a suction line heat exchanger 252 having a leg 254 (heat absorption leg) along the suction line between the first separator gas outlet and the first compressor inlet. The leg 254 is in heat exchange relationship with a leg 256 (heat rejection leg) in the heat rejection heat exchanger outlet line between the heat rejection heat exchanger outlet and the ejector primary inlet.

Figure 8:
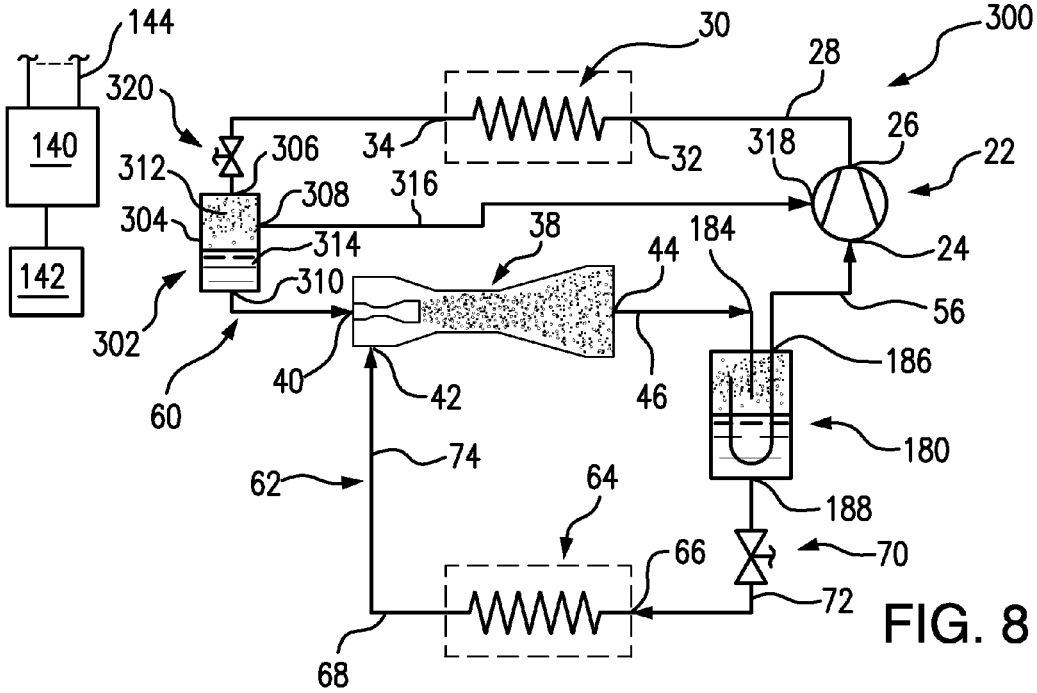
FIG. 8 is a schematic view of a third refrigeration system.

FIG. 8 shows a system 300 which, as is the system 250, may be formed as a modification of the systems of FIG. 1 or FIG. 3. The system 300 features a flash tank economizer 302 between the heat rejection heat exchanger outlet and the ejector primary inlet. The economizer has a tank 304 having an inlet 306, a first outlet (gas outlet) 308, and a second outlet (liquid outlet) 310. The exemplary inlet 306 and outlet 308 are along a headspace 312 which fills with gas. The exemplary second outlet 310 is along the lower portion containing a liquid accumulation 314. The second outlet 310 feeds liquid refrigerant to the ejector primary inlet. The first outlet 308 feeds an economizer line 316 which is coupled to an economizer port 318 of the compressor at an intermediate stage of compression between the compressor suction port and compressor discharge port. A valve 320 may be positioned between the heat rejection heat exchanger outlet and the economizer inlet. The valve 320 serves to provide a pressure drop from the heat rejection exchanger to the economizer pressure, which is a sub-critical intermediate pressure between the compressor discharge pressure and accumulator pressure. Part of the liquid or supercritical refrigerant entering the valve 320 is vaporized, thus cooling the remaining liquid.

Figure 9:
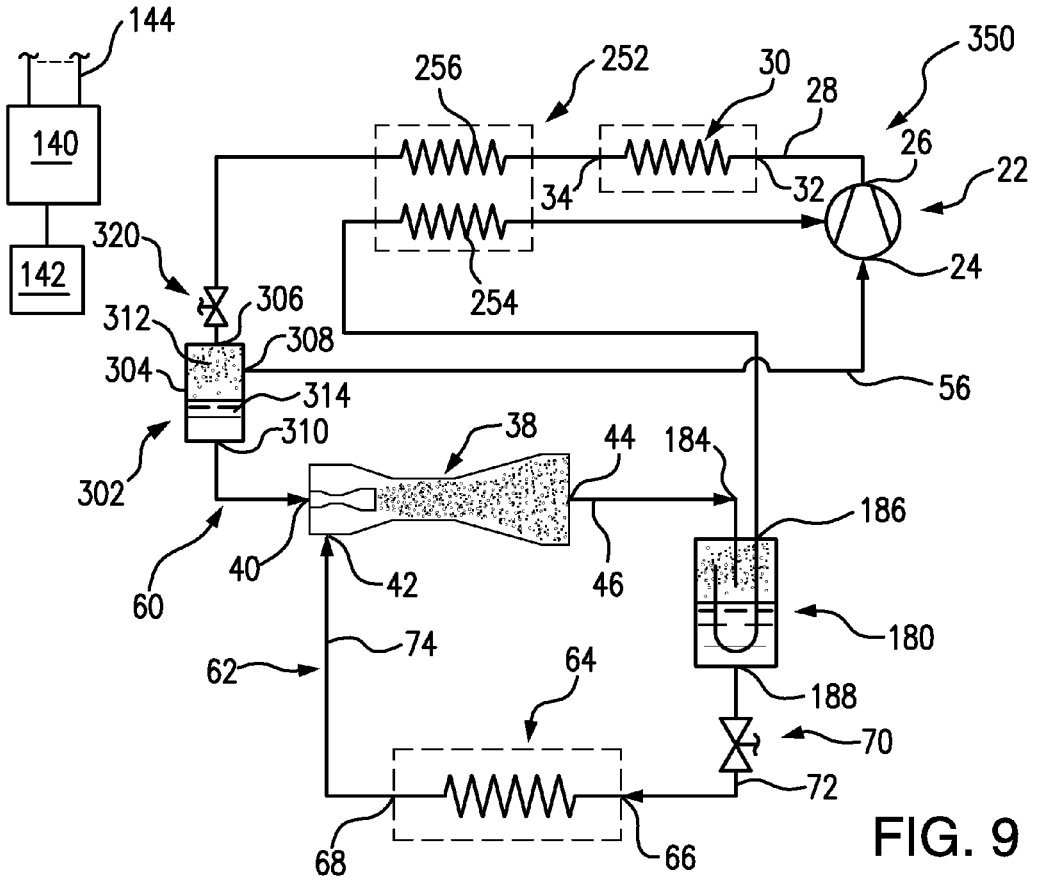
FIG. 9 is a schematic view of a fourth refrigeration system.

FIG. 9 shows a system 350 combining the economizer of FIG. 8 with the SLHX of FIG. 7. The exemplary heat rejection leg of the SLHX is between the heat rejection heat exchanger outlet and the valve 320.

The selection of hole geometry, size, and positioning may be iteratively optimized to provide desired approximate separator outlet flow conditions for a given target operating condition. Under an actual range of operating conditions, there may otherwise be departures from the desired qualities of the separator outlet flows. There may be active control by the controller 140 (e.g., by processor running a program stored in memory to provide the control) so as to achieve a desired flow composition (or at least closer to desired). In one set of examples, a sensor system used is a dual sensor system (e.g., dual thermistor) wherein the first sensor (e.g., thermistor) is allowed to self heat (e.g., by providing excess current beyond the recommended input for operating the sensor) and the other sensor acts as a regular sensor and measures the temperature (e.g., a thermocouple, resistance temperature detector, or thermistor). The self-heat sensor heats up relatively more when it senses vapor than when it senses liquid. The quality can then be calculated by the controller via the reading difference between the self-heat sensor and the regular sensor (based upon the known performance difference of the two sensors).

A first exemplary pair of these sensors 600 (self heat sensor) and 602 (regular sensor) is shown in the suction line 56 between the outlet 186 and the suction port 24 of FIG. 3. A second exemplary pair 604, 606 is shown along the line 74 downstream of the evaporator and upstream of the ejector secondary inlet in FIG. 3. An alternative method is to use the measured discharge superheat and, through known calibration of the compressor isotropic efficiency, have the controller determine the suction quality condition. This may be determined via a discharge superheat sensor 610 in the discharge line at the exit of the compressor. This may be a relatively cost effective method for measuring the quality of refrigerant discharged from the outlet 186. A third variation involves a superheat sensor 614 (FIG. 3) within the compressor downstream of the motor.

The controller may control the quality in line 74 downstream of the evaporator toward a desired value by controlling the valve 70. This, in turn has a smaller feedback effect on the quality discharged by the separator to the valve 70. Opening valve 70 decreases the quality (increasing liquid content) discharged from the evaporator; whereas closing valve 70 increases the quality (decreasing liquid content). If valve 70 is closed sufficiently, the refrigerant state in line 74 becomes superheated.

The controller may more directly control the quality of the refrigerant flow from the first outlet 86 than from the second outlet 88. However, this may be performed indirectly by varying the compressor speed to control quality in line 56 upstream of the compressor. Because the compressor speed is normally varied in order to control system capacity, this level of control would likely only be done if the quality exceeds an undesirable threshold. For example, if the quality must be kept above 90% to ensure proper compressor operation, when the controller detects that the quality drops below this threshold it may increase the compressor speed to increase the quality.

The system may be fabricated from conventional components using conventional techniques appropriate for the particular intended uses.

Although an embodiment is described above in detail, such description is not intended for limiting the scope of the present disclosure. It will be understood that various modifications may be made without departing from the spirit and scope of the disclosure. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. A system (170; 250; 300; 350) comprising:
a compressor (22);
a heat rejection heat exchanger (30) coupled to the compressor to receive refrigerant compressed by the compressor;
an ejector (38) having:
a primary inlet (40) coupled to the heat rejection heat exchanger to receive refrigerant;
a secondary inlet (42); and
an outlet (44);
a heat absorption heat exchanger (64); and
means (180) for providing a 1-10% quality refrigerant to the heat absorption heat exchanger.

2. The system of claim 1 wherein the means comprises:
an inlet (184) coupled to the outlet of the ejector;
a first outlet (186) coupled to said at least one of the compressor and suction line heat exchanger; and
a second outlet (188) coupled to the heat absorption heat exchanger to deliver refrigerant to the evaporator,
wherein a tube (190) has a portion (198) immersed in a liquid refrigerant accumulation (200) and has at least one hole (204) along the portion, at least one hole (204) positioned to entrain liquid (202) from the accumulation (200) in a flow of gas (196) through the tube from a headspace (194) to the first outlet (186).

3. The system of claim 2 wherein:
the tube is a U-tube having a gas inlet end (192) open to the headspace and extending to the first outlet.

4. The system of claim 1 wherein the means comprises:
an inlet (184) coupled to the outlet of the ejector;
a first outlet (186) coupled to said at least one of the compressor and suction line heat exchanger; and
a second outlet (188) coupled to the heat absorption heat exchanger to deliver refrigerant to the evaporator,
wherein a tube (220) has a portion (226) immersed in a liquid refrigerant accumulation (200) and has at least one hole (228) along the portion, the at least one hole (228) positioned to draw liquid (232) from the accumulation (200) to the second outlet (188), the tube (220), further having at least one hole (224) in the headspace.

5. The system of claim 1 further comprising:
an expansion device (70) directly upstream of the heat absorption heat exchanger (64) inlet (66).

6. The system of claim 1 wherein:
the system has no other ejector.

7. The system of claim 1 wherein:
the system has no other compressor.

8. The system of claim 1 wherein:
refrigerant comprises at least 50% carbon dioxide, by weight.

9. The system of claim 1 wherein:
the means is further means for providing an 85-99% quality refrigerant to at least one of the compressor and, if present, a suction line heat exchanger.

10. A method for operating a system comprising:
a compressor (22);
a heat rejection heat exchanger (30) coupled to the compressor to receive refrigerant compressed by the compressor;
an ejector (38) having:
a primary inlet (40) coupled to the heat rejection heat exchanger to receive refrigerant;
a secondary inlet (42); and
an outlet (44);
a heat absorption heat exchanger (64); and
means (180) for providing at least one of a 1-10% quality refrigerant to the heat absorption heat exchanger and an 85-99% quality refrigerant to at least one of the compressor and, if present, a suction line heat exchanger,
the method comprising running the compressor in a first mode wherein:

the refrigerant is compressed in the compressor;

refrigerant received from the compressor by the heat rejection heat exchanger rejects heat in the heat rejection heat exchanger to produce initially cooled refrigerant;

the initially cooled refrigerant passes through the ejector;

an outlet flow of refrigerant from the ejector passes to the means, forming a liquid accumulation (200) with a headspace (194) thereabove;

a flow (196) of gas from the headspace entrains liquid (202) from the accumulation to provide said 85-99% quality refrigerant; and gas (230) from the headspace is introduced to liquid (232) from the accumulation to form an outlet flow (189) of said 1-10% quality refrigerant.

11. The method of claim 10 wherein:

compressor speed is controlled to, in turn control quality of said 85-99% quality refrigerant; and a valve is controlled to, in turn, control quality of said 1-10% quality refrigerant.

12. The method of claim 10 wherein:

compressor speed is controlled to, in turn control quality of said 85-99% quality refrigerant responsive to measuring of discharge superheat and, through known calibration of the compressor isotropic efficiency determining a compressor suction quality condition.

13. A system (170; 250; 300; 350) comprising:

a compressor (22);

a heat rejection heat exchanger (30) coupled to the compressor to receive refrigerant compressed by the compressor;

ejector (38) having:

a primary inlet (40) coupled to the heat rejection heat exchanger to receive refrigerant;

a secondary inlet (42); and an outlet (44);

a heat absorption heat exchanger (64) coupled to the outlet of the first ejector to receive refrigerant; and a separation device having:

an inlet coupled to the outlet of the ejector (184);

a first outlet (186) coupled to said at least one of the compressor and suction line heat exchanger; and a second outlet (188) coupled to the heat absorption heat exchanger to deliver refrigerant to the evaporator, wherein:

a first tube (190) has a portion (198) immersed in a liquid refrigerant accumulation (200) and has at least one hole (204) along the portion, at least one hole (204) positioned to entrain liquid (202) from the accumulation (200) in a flow of gas (196) through the tube from a headspace (194) to the first outlet (186); and a second tube (220) has a portion (226) immersed in a liquid refrigerant accumulation (200) and has at least one hole (228) along the portion, the at least one hole (228) positioned to draw liquid (232) from the accumulation (200) to the second outlet (188), the second tube (220), further having at least one hole (224) in the headspace.

14. The system of claim 13 wherein:

the first tube is a U-tube having a gas inlet end (192) open to the headspace and extending to the first outlet.

15. A refrigerant separator comprising:

a vessel (182);

an inlet (184):

a first outlet (186);

a second outlet (188);

means (220) for providing a 1-10% quality refrigerant to the second outlet.

16. The system of claim 15 further comprising:

a tube (190) having a portion (198) immersed in a liquid refrigerant accumulation (200) and has at least one hole (204) along the portion, at least one hole (204) positioned to entrain liquid (202) from the accumulation (200) in a flow of gas (196) through the tube from a headspace (194) to the first outlet (186).

17. A system (300; 350) comprising:

a compressor (22);

a heat rejection heat exchanger (30) coupled to the compressor to receive refrigerant compressed by the compressor;

an ejector (38) having:

a primary inlet (40) coupled to the heat rejection heat exchanger to receive refrigerant;

a secondary inlet (42); and an outlet (44);

a heat absorption heat exchanger (64);

means (180) for providing at least one of a 1-10% quality refrigerant to the heat absorption heat exchanger and an 85-99% quality refrigerant to at least one of the compressor and, if present, a suction line heat exchanger (250);

a flash tank economizer (302) between the heat rejection heat exchanger and the ejector primary inlet.

18. The system of claim 17 wherein:

the flash tank economizer has a gas outlet (308) coupled to an economizer port (318) of the compressor.

19. The system of claim 17 wherein:

the flash tank economizer has a gas outlet (308) coupled to a suction port (24) of the compressor.

20. The system of claim 17 wherein:

the suction line heat exchanger is coupled to an economizer port (318) of the compressor.

* * * * *